US005081960A

United States Patent [19]

Shimamoto

[11] Patent Number: 5,081,960

[45] Date of Patent: Jan. 21, 1992

[54] COOLING ARRANGEMENT FOR MULTI-VALVE ENGINE

[75] Inventor: Makoto Shimamoto, Iwata, Japan

[73] Assignee: Yamaha Hatsudoki Kabushiki Kaisha, Iwata, Japan

[21] Appl. No.: 630,322

[22] Filed: Dec. 19, 1990

[30] Foreign Application Priority Data

Nov. 12, 1989 [JP] Japan ..... 1-321157

[51] Int. Cl.[5] ..... F02F 1/36

[52] U.S. Cl. ..... 123/41.82 R; 123/41.32

[58] Field of Search ..... 123/41.32, 41.76, 41.82 R, 123/432

[56] References Cited

U.S. PATENT DOCUMENTS 4,009,693 3/1977 Bailey et al. ..... 123/41.82 R 4,714,058 12/1987 Oda et al. ..... 123/41.82 R 4,972,807 11/1990 Morishita ..... 123/41.82 R

*Primary Examiner*—Noah P. Kamen

*Attorney, Agent, or Firm*—Ernest A. Beutler

[57] ABSTRACT

A cylinder head cooling jacket arrangement for an internal combustion engine having a pair of adjacent exhaust ports that extend from the combustion chamber to exhaust port openings formed in the side of the cylinder head. A spark plug well is formed between the exhaust passages and thus provides a vertical wall that precludes the flow of coolant from between the exhaust passages to the opposite side of the cylinder head. Several embodiments of arrangements are provided for insuring a circulating flow of coolant through a cooling jacket formed between the passages and the spark plug well.

18 Claims, 10 Drawing Sheets

COOLING ARRANGEMENT FOR MULTI-VALVE ENGINE

BACKGROUND OF THE INVENTION

This invention relates to a cooling arrangement for a multi-valve engine and more particularly to an improved cooling arrangement for the cylinder head of such an engine.

The advantages of multi-valve engines are well known. Although the efficiency and output of an engine can be increased by increasing the number of valves, the use of multiple valves gives rise to certain problems. One of these problems has to do with the configuration of the cooling jacket within the cylinder head. Normally the flow of coolant through the cylinder head is from end to end or across the cylinder head from one side to the other. However, in connection with the use of multiple valves and multiple ports an arrangement may result wherein a pocket is formed in the cooling jacket between the ports and circulation of coolant through this pocket is obstructed.

For example, it is frequently the practice to employ a pair of exhaust ports that extend through one side of the cylinder head with a spark plug well formed between these exhaust ports. Of course, it is also desireable to make the exhaust ports as large as possible and this restricts the area through which coolant may flow. In addition, the internal structure of the cylinder head may give rise to the formation of a wall that extends between the exhaust ports through the spark well and which precludes the flow of coolant from this well to the opposite side of the engine. As a result, hot spots can occur.

It is, therefore, a principal object of this invention to provide an improved cooling arrangement for a multi-valve engine.

It is a further objection of this invention to provide a cooling arrangement for a multi-valve engine wherein large valve ports may be accommodated and wherein the flow of coolant through the area between the valve ports is promoted.

It is a further objection of this invention to provide an improved arrangement for cooling the exhaust ports of a multiple valve internal combustion engine.

SUMMARY OF THE INVENTION

This invention is adapted to be embodied in a cooling jacket arrangement for a cylinder head of an internal combustion engine that defines in part a combustion chamber. A pair of passages extend from valve seats in the combustion chamber to respective port openings formed in the same exterior surface of the cylinder head. A spark plug well is formed in the exterior of the cylinder head and is adapted to receive a spark plug for the combustion chamber. The passages and spark plug well lie substantially on one side of the cylinder head. A cooling jacket is formed by the portion of the cylinder head defined by the passages and the spark plug well and means direct coolant flow in a generally vertical direction through the cooling jacket.

DETAILED DESCRIPTION OF THE PREFERRED EMBODIMENTS OF THE INVENTION

Figure 1:
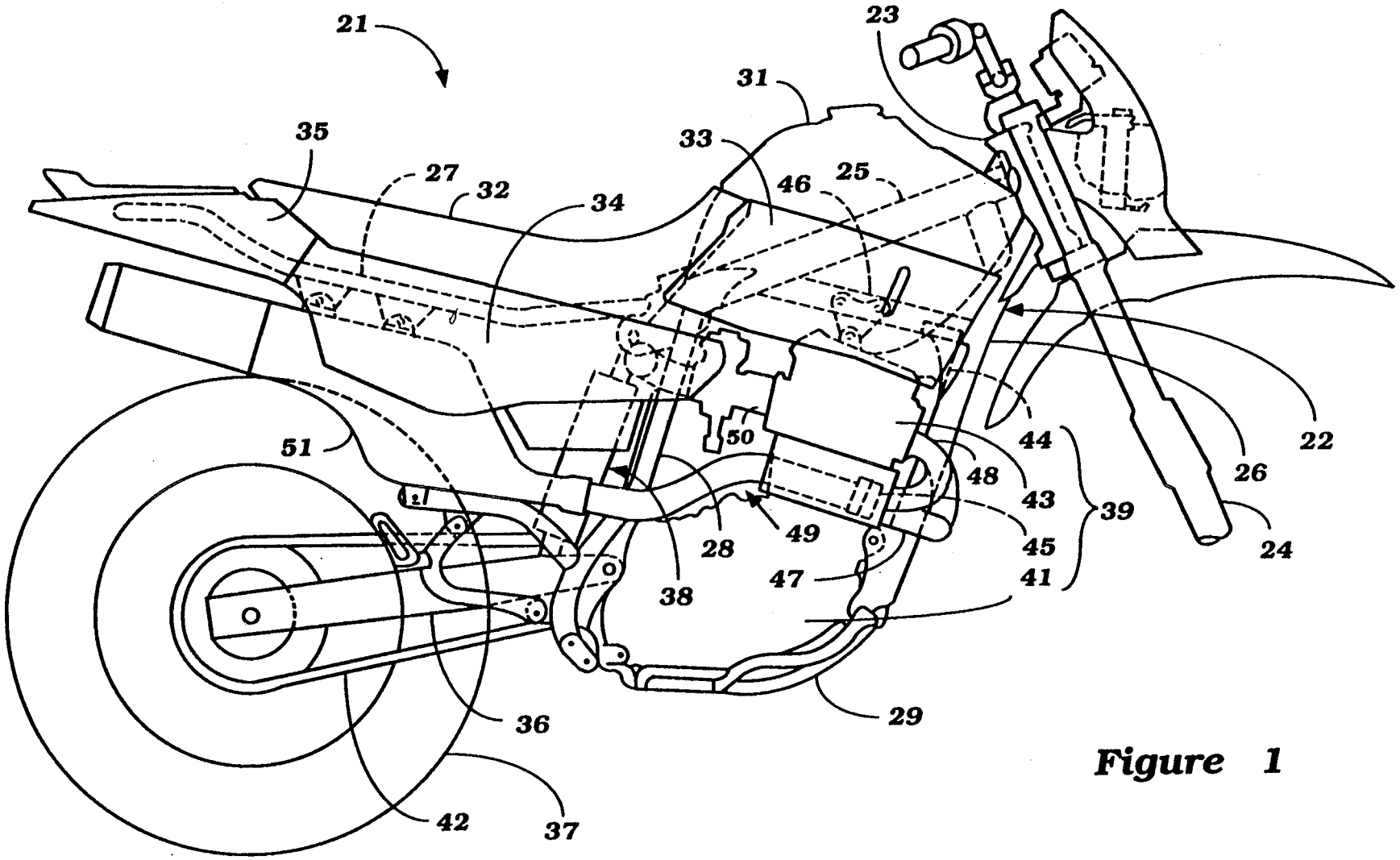
FIG. 1 is a partial side elevational view of a motorcycle powered by an internal combustion engine constructed in accordance with a first embodiment of the invention.
Figure 2:
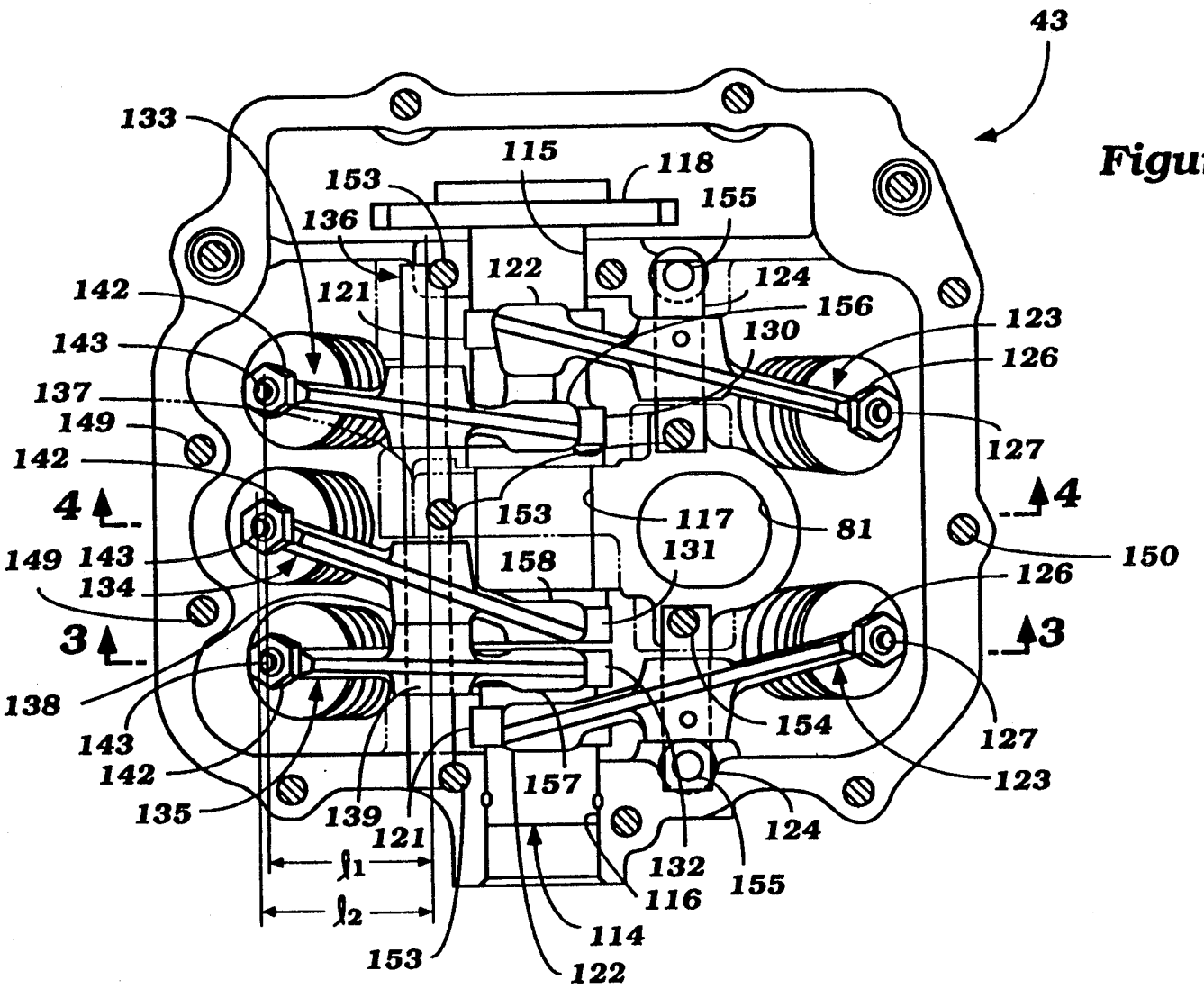
FIG. 2 is a top plan view, showing the cylinder head assembly of the engine, with the cam cover removed.

Referring first to FIG. 1, a motorcycle powered by an internal combustion engine constructed in accordance with an embodiment of the invention is identified generally by the reference numeral 21. The invention is described in conjunction with a motorcycle since it has particular utility in conjunction with such this type of vehicle. It is to be understood, however, that certain facets of the invention may be utilized in conjunction with internal combustion engines that power other types of vehicles or, for that matter, other applications for internal combustion engines.

The motorcycle 21 includes a welded frame assembly 22 having a head pipe 23 that journals a front fork 24 for steering movement. A front wheel (not shown) is journaled by the front fork 24 in a known manner.

The frame 22 further includes a main frame tube 25, a down tube 26, a seat rail 27 and a seat pillar 28. At the lower end of the frame, an underguard 29 spans the down tube 26 and the seat pillar 28.

A fuel tank 31 is positioned behind the head pipe 23 and ahead of a seat 32 that is carried by the seat rail 27. A small body assembly comprised of a side cover for the tank 31 and air scoop 33, a side covering for the lower portion of the seat 34 and a rear cover 35 are suitably affixed to the frame 22.

A trailing arm 36 suspends a rear wheel 37 from the frame assembly in a suitable manner, including a combined spring shock absorber 38 that lies generally on the longitudinal center plane of the motorcycle 21.

The rear wheel 37 is powered by an engine unit 39 which is comprised of a water cooled, single cylinder, four cycle, five valve, single overhead cam engine. A crankcase assembly 41 of the engine unit 39 contains a change speed transmission which is driven by the engine crankshaft and which drives the rear wheel 37 through a chain 42. Although the details of the engine unit 39 and specifically the engine portion of it will be described by references to the remaining figures, the engine unit 39 includes a cylinder head 43, a cam cover 44 and a cylinder block 45 in addition to the crankcase 41. This engine unit is mounted in the frame 22 with the cylinder block 45 inclined slightly forward in a suitable manner by means including a support pipe 46 that is positioned beneath the main pipe 25 and which is joined to the main pipe 25 and the down tube 26

As will become apparent, the engine unit 39 has a pair of forwardly facing exhaust ports from which a pair of exhaust pipes 47 and 48 extend into an exhaust system, indicated generally by the reference numeral 49 and which includes a side mounted muffler 51.

The engine unit 39 also includes an induction system including an air box (not shown) that supplies air to a pair of carburetors 52 which serve three rearwardly facing exhaust ports, as will be described by reference to the remaining figures.

Figure 3:
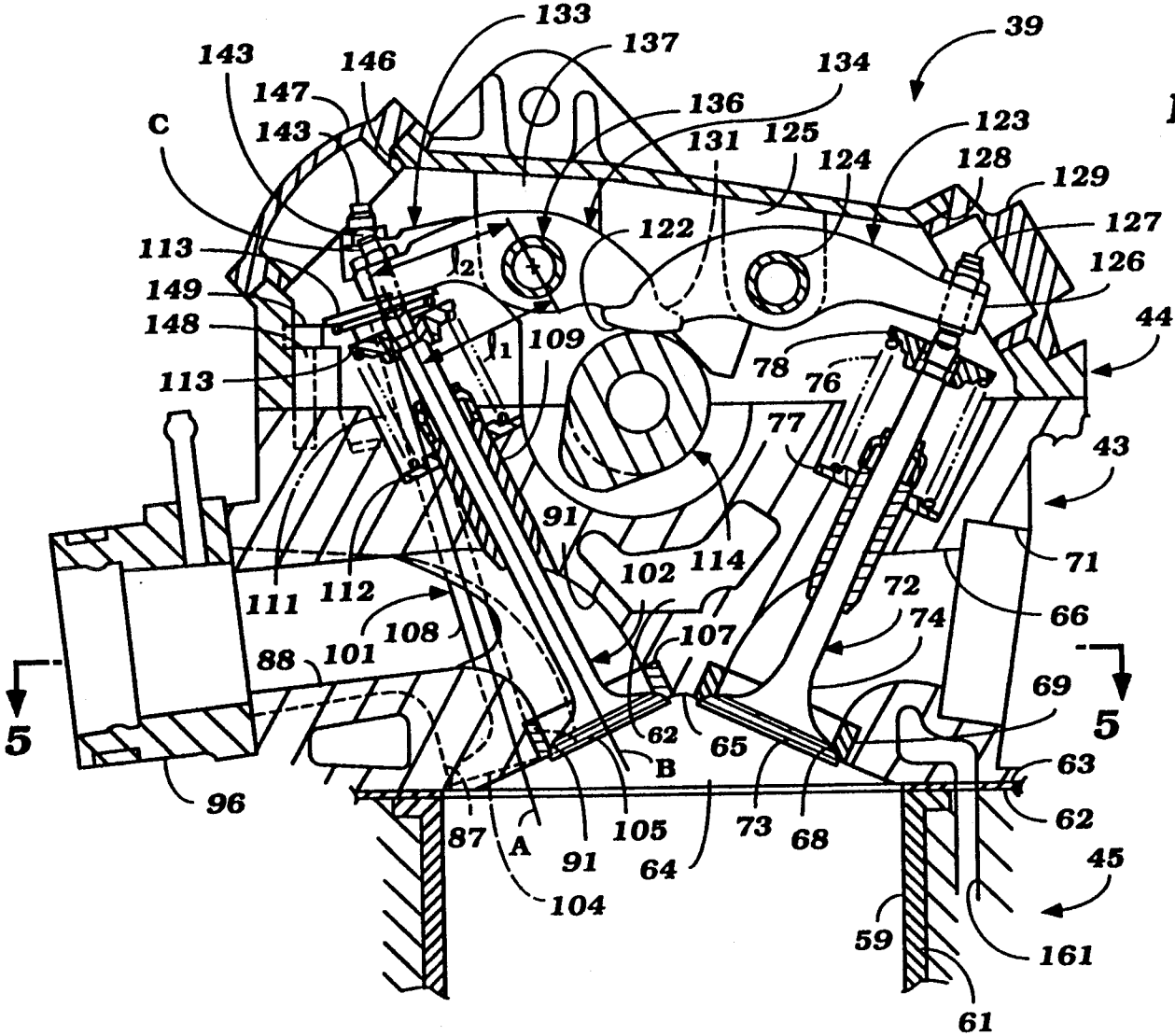
FIG. 3 is a cross sectional view of the complete cylinder head assembly and a portion of the associated cylinder block taken along the line 3—3 of FIG. 2.
Figure 4:
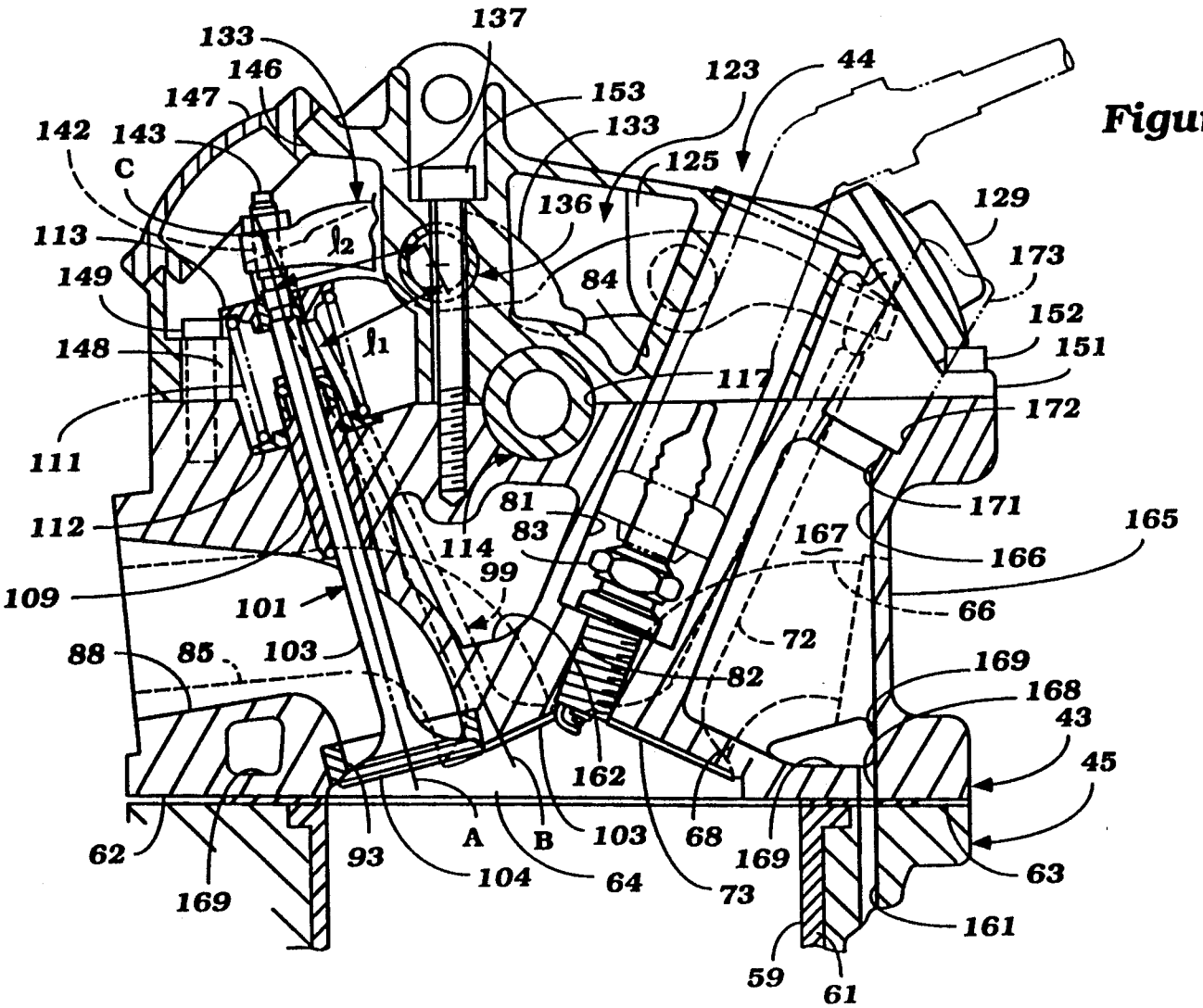
FIG. 4 is a cross sectional view taken along the line 4—4 of FIG. 2.
Figure 5:
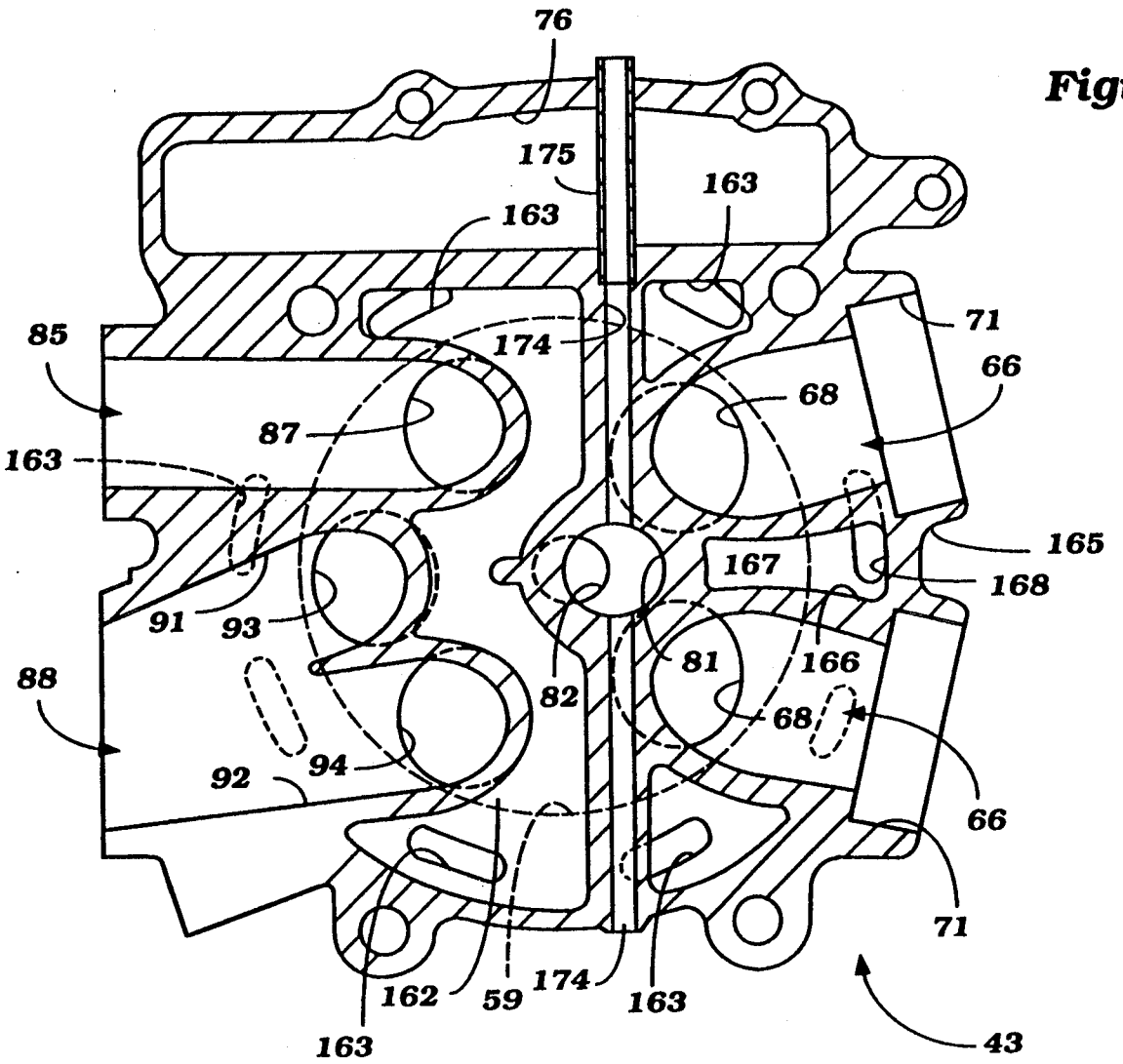
FIG. 5 is a cross sectional view taken along the line 5—5 of FIG. 3.
Figure 6:
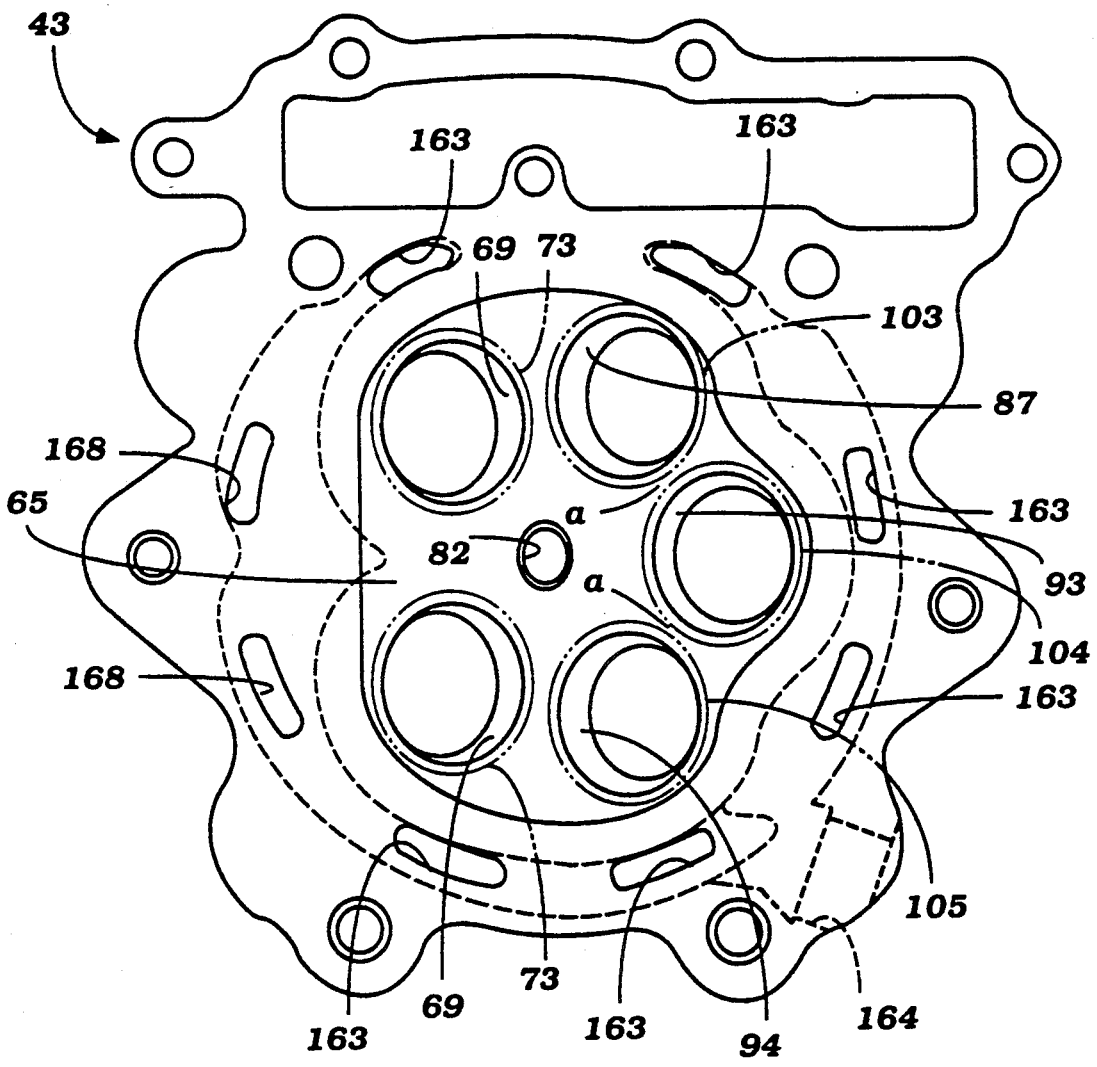
FIG. 6 is an inverted plan view of the cylinder head with the valves and spark plug removed.

Referring now to FIGS. 3 and 4 it will be noted that the cylinder block 45 is formed with a cylinder bore 59 which is formed by a pressed or cast in liner 61. A piston (not shown) reciprocates within the cylinder bore 59 and drives the crankshaft (not shown) contained within the crankcase 41 in a well known manner. Since the invention deals primarily with the cylinder head 43, the valve train associated with it and its cooling system, those components of the engine which are considered to be conventional have not been illustrated and further description of them is not believed to be necessary to enable those skilled in the art to practice the invention.

The cylinder head 43 has a lower surface 62 that is sealingly engaged with a head gasket 63 so as to provide a seal with the cylinder block 45 around the cylinder bore 59. In addition, the cylinder head 43 is formed with a generally central recess 64 which recess is defined by a surface 65 surrounded by the lower cylinder head surface 62. This recess has a generally spherical configuration although it assumes a pent roof type of configuration as may be best seen in FIGS. 3 and 4.

Referring now primarily to FIGS. 2 through 6, the cylinder head 43 is formed with a pair of forwardly facing exhaust passages 66 each of which extends from the combustion chamber 66 through a valve seat 64 formed by a pressed in insert 69. These exhaust passages 66 terminate in forwardly facing exhaust ports 71 to which the respective exhaust pipes 47 and 48 are affixed in a suitable manner.

A pair of exhaust valves 72 each of which has a head portion 73 and a stem portion 74 are slideably supported for reciprocation within the cylinder head 43 by a respective pressed in valve guide 75. The exhaust valves 72 reciprocate within a common plane that is inclined at an acute angle to a plane containing the axis of the cylinder bore 59. The axes of reciprocation also lie in planes that are parallel to each other and to the cylinder bore axis. This facilitates operation of the valve although they may be slightly inclined if desired. The exhaust valves 72 are urged to their closed positions by means of respective coil compression springs 76 that engage wear plates 77 bearing against the cylinder head 43 and keeper retainer assemblies 78 affixed in a known manner to the upper ends of the exhaust valve stems 74. The exhaust valves 72 are opened in a manner which will be described.

It should be noted that the exhaust passages 66 and 67 are disposed at an angle to the plane containing the cylinder bore axis and thus diverge from a plane perpendicular to this plane and also passing through the cylinder bore axis. This permits the exhaust pipes 47 and 48 to clear the down tube 26 and also provides a better and less flow resistant path for the entire exhaust system.

A spark plug well 81 (FIG. 4) is formed in the cylinder head 43 between the exhaust passages 66 and terminates at a threaded opening 82 in which a spark plug 83 is received. The spark plug 83 is disposed so that its gap lies substantially on the cylinder bore axis. A corresponding well 84 is formed in the cam cover 44 so as to facilitate insertion and removal of the spark plug 83 without removing the cam cover 44. The spark plug 83 is fired by a suitable ignition system.

A primary intake passage 85 extends through the opposite side of the cylinder head 43 from the exhaust side already described. The passage 85 extends from an intake port 86 formed in the side of the cylinder head 43 and terminates at a valve seat 87 formed by a pressed in insert. As may be best seen in FIG. 7, the primary intake passage 85 has a central axis that is generally perpendicular to the aforenoted plane containing the cylinder bore axis and hence as a relatively short length from its intake port 86 to its valve seat 87. As a result, good, low and mid range performance and good response may be achieved. A siamese type secondary intake passage 88 extends from an intake port 89 formed in the intake side of the cylinder head 43 and branches into a pair of passages 91 and 92 each of which terminates at a respective valve seat comprised of a center valve seat 93 and a side valve seat 94. The center of the intake port 89 as extended by a spacer, to be described, is disposed at the same distance from a plane perpendicular to the cylinder bore axis perpendicular to the aforementioned plane as the port 86, as extended. The carburetors 52 are affixed to these respective intake ports 86 and 89 through the intermediary of respective spacers 95 and 96 which have respective passage ways 97 and 98 that form extensions of the cylinder head intake passages 85 and 88. By utilizing the spacers it is possible to have this equal distance between the centers of the ports even though the actual port 89 is closer to the perpendicular plane than is the inlet of the passage 98 and its spacer. This construction permits the induction system to clear the shock absorber and spring assembly 38 and avoids interference between the carburetors 52.

A central effective line or bisector of the secondary intake passage 88 lies at an acute angle to the perpendicular plane while the portion 92 extends generally perpendicularly to the plane containing the axis of the cylinder bore as aforenoted. As a result, the intake passages serving the side valve seats 87 and 94 are relatively short while the passage 91 is somewhat longer. This variation in length can be employed so as to achieve the desired flow pattern in the engine.

The carburetor 52 that serves the intake passage 85 is sized and jetted and has a throttle valve (not shown) that functions to control both the low speed and mid range performance of the engine as well as the high speed performance. The throttle valve (not shown) of the carburetor 52 that serves the secondary passage 88 is operated in a staged sequence with the primary carburetor and may only have high speed circuits since this carburetor supplies the fuel air charge only to the engine under high speed operation. Either a staged linkage system or some form of load or speed responsive control (such as a vacuum responsive servo motor) can be employed for operating the throttle valve of the secondary carburetor 52 in this staged sequence.

First, second and third poppet type intake valves 99, 101 and 102 have respective head portions 103, 104 and 105 which cooperate with the valve seats 87, 93 and 94 for controlling the flow through them. The intake valves 99 and 102 are side valves and have their respective stem portions 106 and 107 slidable supported in guides, to be described, for reciprocation about axes B which are in a common plane disposed at an acute angle to the plane containing the cylinder bore axis which acute angle may be substantially the same as the acute angle of reciprocation of the exhaust valves 72. The center exhaust valve 101 has its stem portion 108 supported for reciprocation about an axis A which is disposed also at an acute angle to the aforenoted plane containing the cylinder bore axis but which acute angle is lesser than the angle of reciprocation B of the valves 99 and 101. The angular disposition of the reciprocal axes A and B is such that these axes intersect a line C which is parallel to the plane containing the cylinder bore axis but which is spaced from the tips of the individual intake valves 99, 101 and 102. As a result of this, the angular configuration of the side valves 99 and 102 relative to the center valve 101 is relatively small. This configuration permits the adjacent area between the intake valves as indicated at "a" in FIG. 6 to be relatively smooth and thus provide a smooth combustion chamber configuration that will avoid hot spots and still permit a generally spherical configuration.

The axes A and B of reciprocation of the intake valves 101 and 99 and 102 all lie in parallel planes which planes are parallel to the axis of the cylinder bore. This permits ease of operation. However, if desired, these axes may be slightly skewed from parallel planes as is also possible with the exhaust valve 72, as previously noted.

The valve guides that slidable support the stems 106, 107 and 108 of the intake valves 99, 102 and 101 are each indicated by the reference numeral 109. Intake valve springs 111 engage bearing plates 112 that bear against the cylinder head 43 and keeper retainer assemblies 113 affixed to the upper ends of the respective valve stems for urging the intake valves 99, 101 and 102 to their closed positions. The intake valves 99, 101 and 102 are operated by means of rocker arm assemblies to be described.

The exhaust valves 72 and intake valves 99, 101 and 102 are all operated by means of a single overhead camshaft 114. The camshaft 114 is journaled, in a manner to be described, for rotation about an axis which is offset to the intake side of the cylinder head from the cylinder bore axis. This axis is parallel to the plane aforementioned that contains the axis of the cylinder bore. The camshaft 114 has end bearing surfaces that are journaled in bearing surfaces 115 and 116 (FIG. 2) formed by the cylinder head 43 and corresponding bearing surfaces formed by the cam cover 44. In addition, there is provided a central bearing surface on the camshaft 114 that is journaled by a bearing surface 117 formed in the cylinder head 43. A corresponding bearing surface is partially formed in the cam cover 44 and has its center offset a distance from the cylinder bore axis so as to provide clearance for other components of the cylinder head assembly to be described and specifically one of the rocker arms.

The camshaft 114 is driven from the engine crankshaft by means of a drive chain (not shown) and sprocket 118 that is affixed to one end of the camshaft.

A pair of exhaust cam lobes 121 are formed at the outer ends of the camshaft 114 adjacent the bearings that engage the cylinder head bearing surfaces 115 and 116. These cam lobes 121 are engaged by follower surfaces 122 of exhaust rocker arms 123. These exhaust rocker arms 123 are journaled on stub rocker arm shafts 124 each of which is supported by a boss 125 formed on the inner surface of the cam cover 44.

The outer ends of the rocker arms 123 are provided with taped portions 126 that receive adjusting screws 127 for providing lash adjustment between the exhaust rocker arms 123 and the tips of the stems 74 of the exhaust valves 72 for clearance adjustment. Access openings 128 are provided in the cam cover 44 for facilitating valve adjustment without removal of the cam cover 44. These access openings 128 are normally closed by closure plugs 129 which are affixed in place in a suitable manner.

In addition to the exhaust cam lobes 121, the camshaft 114 is provided with a first intake cam lobe 130 that is disposed between the center bearing surface of the camshaft 114 and the exhaust cam lobe 121 adjacent the bearing surface of the camshaft journaled in the cylinder head bearing surface 115. In addition, a pair of intake cam lobes 131 and 132 are disposed between the center bearing surface of the camshaft 114 and the exhaust cam lobe 121 adjacent the cylinder head bearing surface 116. First 133 second, 134 and third 135 rocker arm assemblies are each journaled upon a single intake rocker arm shaft 136 which is fixed in lugs formed on the cam cover 44. These lugs may be the same lugs as form the bearing surfaces which cooperate with the cylinder head bearing surfaces 115, 116 and 117. The center of these lugs appears in FIGS. 3 and 4 and is indicated generally by the reference numeral 137.

It should be noted that the bearing portion of the intake rocker arm 134, which operates the center intake valve 101, which bearing portion is indicated by the reference numeral 138 has an extended portion 139 which receives and journals the bearing portion 141 of the rocker arm 135. This arrangement provides greater stabilization for the center rocker arm 134 which is important due to its angular configuration, as will be described.

It has already been noted that the intake valves 99 and 102 reciprocate about respective reciprocal axes B and the intake valve 101 reciprocates about the axis A. As has been noted that the axes A and B intersect at a line C which is parallel to the aforenoted plane containing the cylinder bore axis which point C is spaced from the tips of all of the intake valves. However, the center intake valve 101 has its tip disposed at a somewhat higher point from the lower cylinder head surface 62 and also spaced outwardly in a horizontal direction a greater distance 12' than the tips of the side intake valves 99 and 102 which valves lie at the distance 11' from the plane and also from the pivotally axes of the respective rocker arms defined by the rocker arm shaft 136. Also, it should be noted that the center intake valve 101 and specifically its axis B is at a perpendicular distance 11 from the rocker arm shaft 136 whereas the axes of reciprocation A of the other intake valves is a perpendicular distance 12 from this axis. This distance 11 is less than the distance 12. These differences in distance permit the smooth combustion chamber configuration previously noted. Each of the rocker arms 133, 134 and 135 is provided with an enlarged taped portion 142 that receives a respective adjusting screw 143 for cooperation with the tip of the actuated valve for lash adjustment. The cam cover 44 is provided with elongated opening 146 for accessing each of the adjusting screws 143 so that the valve adjustment may be made without removing the cam cover. A removal closure plug 147 normally closes the opening 146 and is removed for servicing.

The cam cover 44 is affixed to the cylinder head 43 by a plurality of fasteners, most of which are accessible from externally of the cam cover 44. However, the cam cover 44 is provided with an inwardly extending bosses 148 (FIGS. 2–4) into which threaded fasteners 149 are received for affixing the cam cover 44 to the cylinder head 43. These fasteners 49 are readily accessible through the service opening 146 when the cover 147 is removed. A corresponding lug 151 is formed on the exterior of the cam cover 44 between the two exhaust rocker arms and is secured to the cylinder head 43 by a threaded fastener 152. Further threaded fasteners, indicated by the reference numerals 153 not only serve to hold the cam cover 44 to the cylinder head 43 but also serve to prevent rotation of the rocker arm shaft 136. Other threaded fasteners 154 serve to hold the cam cover 44 to the cylinder head 43 and also serve to prevent rotation of the rocker arm shafts 124. Further threaded fasteners 155 are fastened into the cam cover and serve only the purpose of preventing rotation of the rocker arm shafts 124.

The rocker arms 133 and 135 have respective follower portions 156 and 157 that engage the cam lobes 124 and 132, respectively. These rockers arms extend in a generally straight direction substantially perpendicularly to the aforementioned plane from the follower portions 156 and 157 to their adjusting screw ends 142. The rocker arm 134, on the other hand, has a follower portion 158 that engages the cam lobe 131 and which extends generally straight to its end 142 that receives the adjusting screw 143 which line lies at an acute angle to the aforenoted plane containing the cylinder bore axis. This configuration is to clear the lug 137 of the cam cover 44 that provides the center bearing for the camshaft 114. It is bent shape that requires the long bearing surface for this rocker arm 134, as aforenoted.

As has been previously noted, the engine 39 is water cooled and to this end the motorcycle 21 is provided with a radiator (not shown) through which heat is exchanged from the coolant of the engine and the atmosphere in a known manner. A water pump (not shown) is driven by the engine in a suitable manner and circulates water to a cooling jacket 161 (FIGS. 3 and 4) that extends in the cylinder block 45 around the cylinder liners 61. In the illustrated embodiment, the liners 61 are dry liners but it is to be understood that the invention can be utilized in conjunction with wet type liners.

The cylinder head 43 is provided with a main cooling jacket, indicated generally by the reference numeral 162 which encircles substantially the intake side of the spark plug well 83, the intake passages 85 and 88, and the outer or intake sides of the exhaust passages 66. Water flows upwardly from the cylinder block 45 to this main cooling jacket 162 through a plurality of arcuate outlets formed in the cylinder block 45 and arcuate inlets formed in the cylinder head 43, such passageways being indicated by the reference numeral 163. This cooling water than exists the cylinder head through a coolant return 164 (FIG. 6) formed in the intake side of the cylinder head adjacent one of the side intake valves, the valve 105 in the illustrated embodiment. This coolant is than returned to the radiator in a suitable manner.

Figure 7:
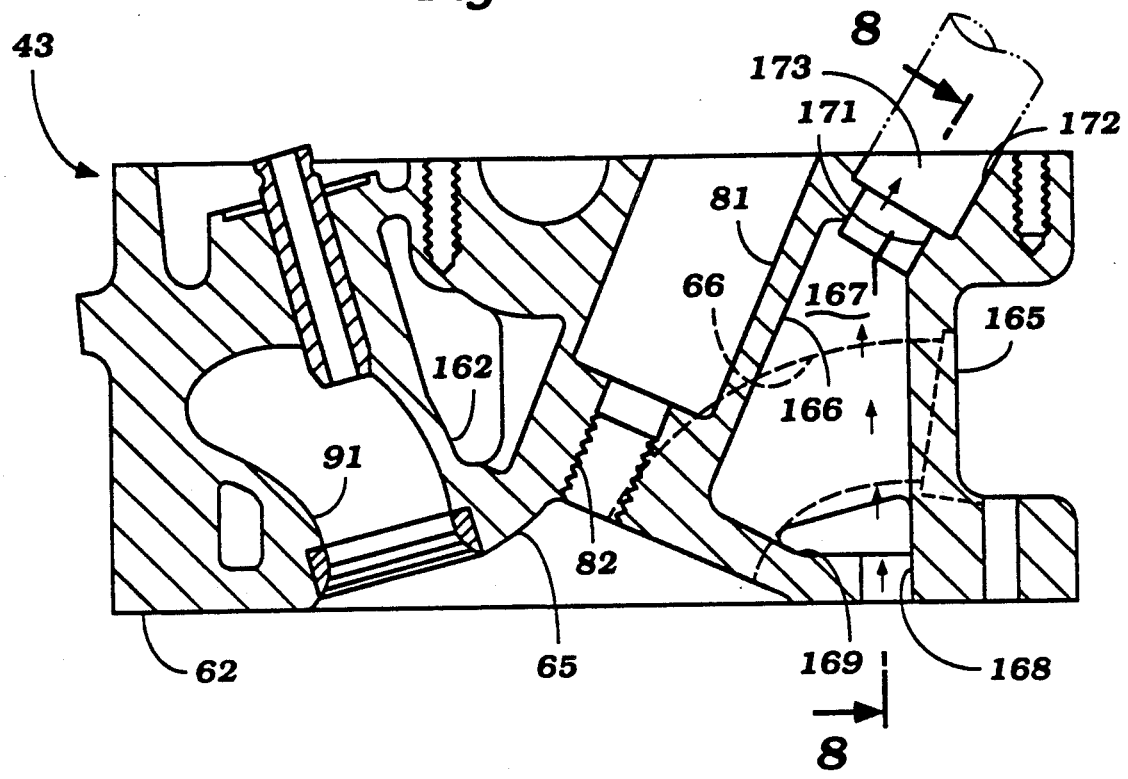
FIG. 7 is a cross sectional view through the center of the cylinder head showing the configuration of the cooling ports and the flow through it with the valves and spark plug removed to more clearly show the construction.
Figure 8:
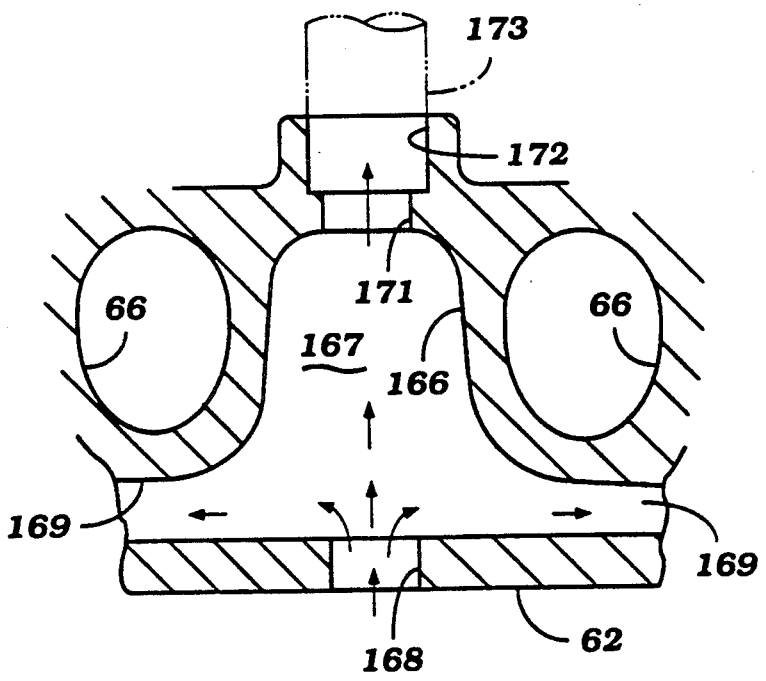
FIG. 8 is a cross sectional view taken along the line 8—8 of FIG. 7.

On the exhaust side of the cylinder head, this being the side where the exhaust ports 66 exists, which side is indicated generally by the reference numeral 165 there is a slightly different problem in connection with the flow of coolant. It may be best seen in FIGS. 4, 5, 7 and 8, the area between the exhaust passages 66 is defined by inner walls 166 that merge into an extension of this wall that extends around the spark plug well 81 and hence defines a generally stagnant area which defines an auxilary or sub-cooling jacket, indicated generally by the reference numeral 167. Coolant is delivered to this sub-cooling jacket 167 from the cylinder block cooling jacket 161 through a passageway 168 formed in the lower surface 62 of the cylinder head 43. A portion of this coolant can exit to the main cooling jacket 162 through passageways formed underneath the exhaust ports 66 by the lower walls 169 thereof as best seen in Figures 7 and 8. However, the bulk of the area of the sub-cooling jacket 167 is generally stagnant with conventional engine constructions and, accordingly, hot spots can occur. In order to promote coolant flow in a vertically upward direction through the sub-cooling jacket 167 there is provided an auxiliary outlet port 171 in the upper surface of the cylinder head which has a counter bored portion 172 to receive an auxiliary outlet fitting 173 (FIGS. 4, 7 and 8). A flexible conduit (not shown) returns coolant from this auxiliary outlet fitting 173 back to the radiator. As a result, there will be good circulation through the auxiliary or sub-cooling jacket 167 and no hot spots will occur.

Although a seal may be provided around the upper end of the spark plug well and specifically the portion thereof formed in the cam cover 44, some moisture may accumulate in this area. There are provided a pair of tranverse drains 174 (FIG. 5) that extend from the well 81 through the cylinder head for draining water therefrom. An extension tube 175 is pressed into the cylinder head 43 and passes through a cavity 176 in which the chain for driving the camshaft 114 is contained so that the water will drain externally of the head rather than internally of it.

Figure 9:
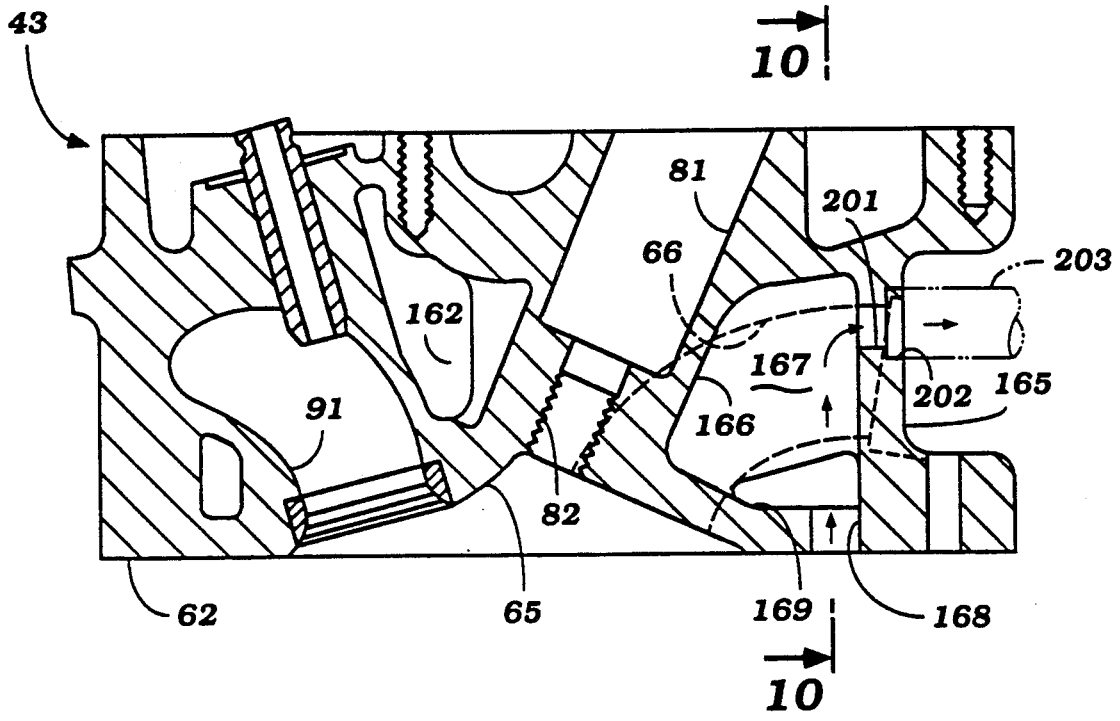
FIG. 9 is a cross sectional view, in part similar to FIG. 7, showing another embodiment of the invention.
Figure 10:
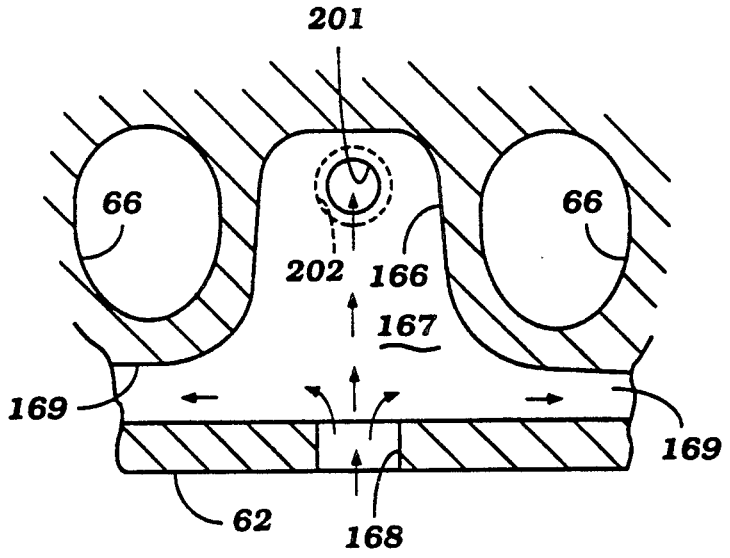
FIG. 10 is a cross sectional view taken along the line 10—10 of FIG. 9.

In the embodiment of the invention as thus far described, the auxiliary cooling jacket 167 has a coolant flow generated through it which extends in a generally vertical direction from the lower cylinder head surface 62 upwardly. In the embodiment as thus far described, this has been achieved by the provision of an auxiliary coolant outlet in the upper portion of the cylinder head 43. In some instances, it may not be desireable to provide this auxiliary outlet in the upper surface and FIG. 9 and 10 show another embodiment of the invention wherein the main components of the engine are the same and, for that reason, embodiment, however, a side auxiliary outlet 201 is formed in an upper portion of the cylinder head side surface 165 between the exhaust ports 66. This outlet 201 is formed with a counter bore 202 that receives a fitting 203 which, in turn, receives a flexible hose (not shown) so as to return coolant to the radiator. As a result, there still will be a substantially vertical flow of coolant through the auxiliary cooling jacket 167 as clearly shown in FIGS. 9 and 10.

Figure 11:
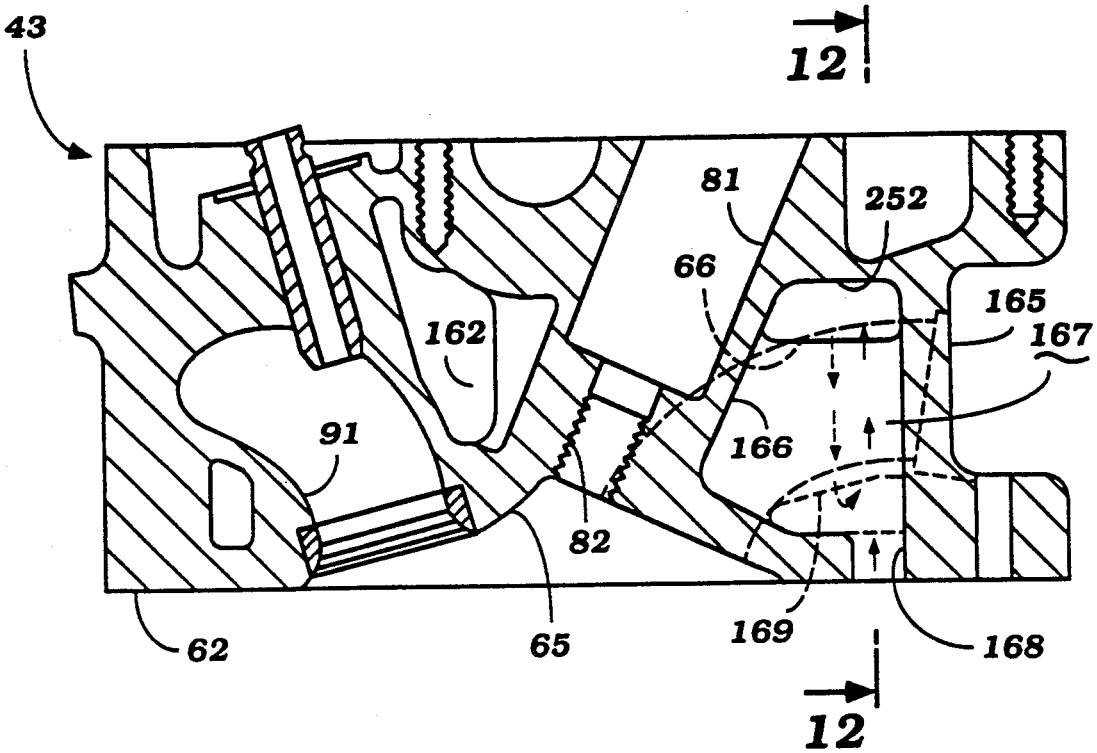
FIG. 11 is a cross sectional view, in part similar to FIGS. 7 and 9, and shows yet another embodiment of the invention.
Figure 12:
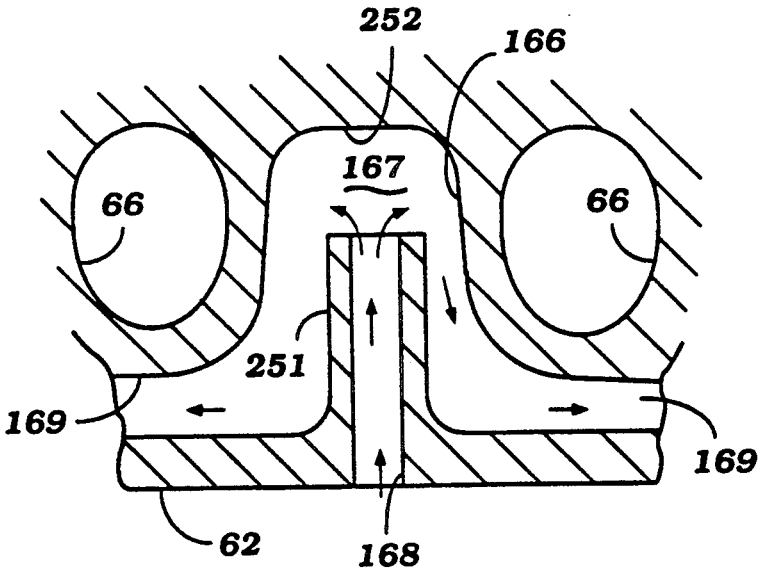
FIG. 12 is a cross sectional view taken along the line 12—12 of FIG. 11.

In the embodiment thus far described, water has been caused to circulate vertically through the auxiliary cooling jacket 167 by providing the lower inlet and an upper outlet. FIGS. 11 and 12 show another embodiment, which is generally similar to the previously described embodiment, but wherein the vertical flow is accomplished in a different manner. Since the main portions of the construction are the same, those components have been identified by the same reference numerals. In this embodiment, the intake port 168 is extended by a cylindrical extension 251 formed internally in the cylinder head 43 and which extends to a point adjacent an upper wall 252 of the cooling jacket 167. Hence, coolant will flow upwardly and impenge upon the wall 252 and be redirected downwardly as shown by the arrows in the figure for exist through the passages 169 Hence, the vertical flow is achieved without necessitating an auxiliary outlet in the cylinder head.

Figure 13:
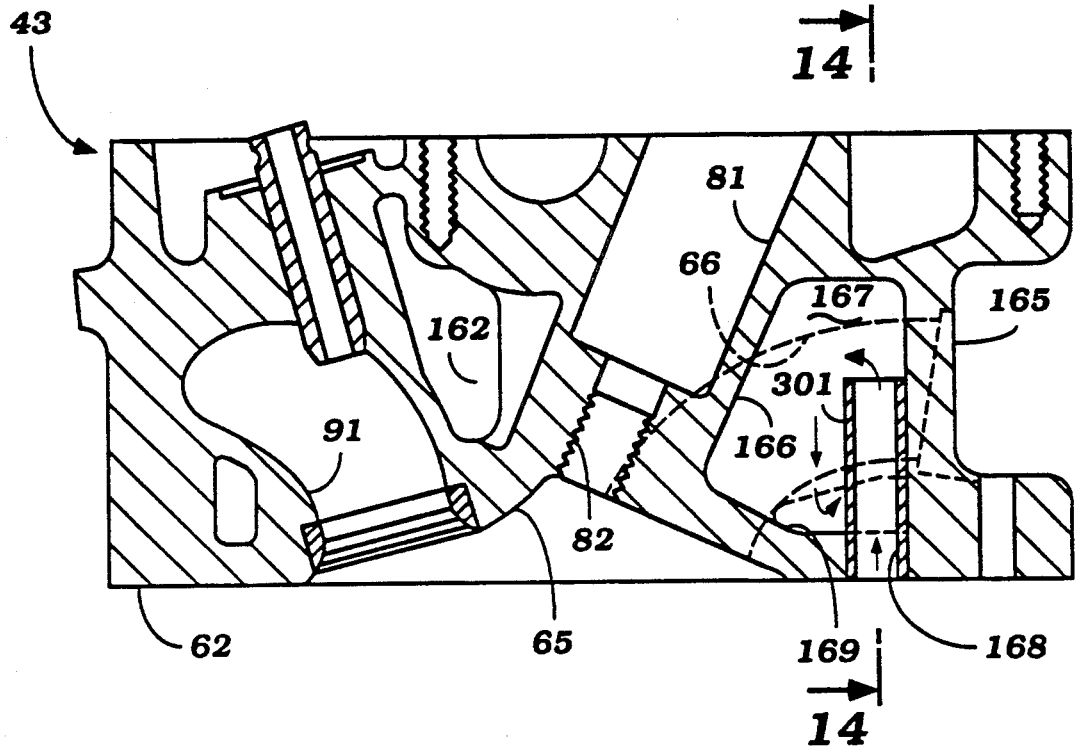
FIG. 13 is a cross sectional view, in part similar to FIGS. 7, 9 and 11, and shows yet another embodiment of the invention.
Figure 14:
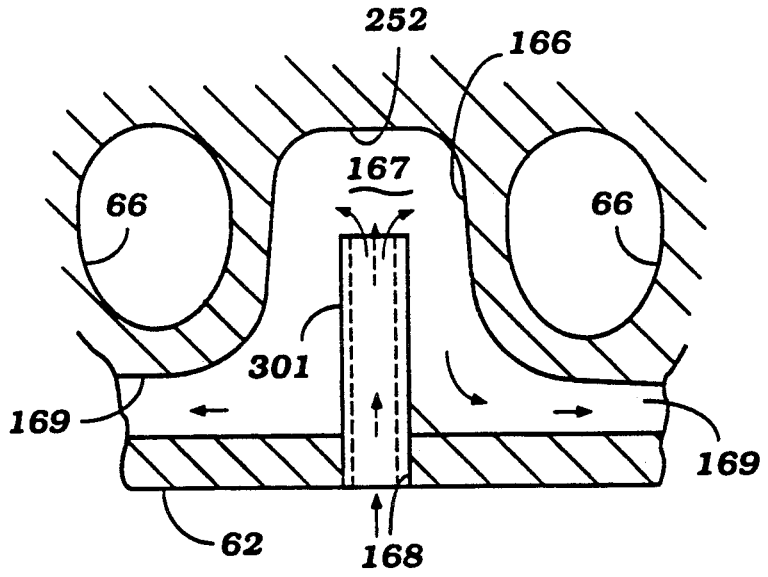
FIG. 14 is a cross sectional view taken along the line 14—14 of FIG. 13.

FIGS. 13 and 14 show yet another embodiment of the invention that has the same type of flow pattern as FIGS. 11 and 12 but which does not require the intricate cylinder head casting of that embodiment. In this embodiment, an insert pipe 301 is pressed into the port 168 and directs the flow upwardly against the cylinder wall upper surface 252 for redirection as aforenoted. Again, the water exists through the passages 169.

In all of the embodiments of the invention as thus fast described, the invention has been discussed in conjunction with a single cylinder engine. It should be readily apparent, however, to those skilled in the art that the invention can be practiced with multiple cylinder engines.

It should be readily apparent from the foregoing description that the embodiments of the invention described all provide an plug well of an internal combustion engine without sacrificing the port size of the configuration of the cylinder head. Of course, the described embodiments are only preferred embodiments of the invention and various changes and modifications may be made without departing from the spirit and scope of the invention, as defined by the appended claims.

I claim:

1. A cooling jacket arrangement for a cylinder head of an internal combustion engine defining in part a combustion chamber, a pair of passages extending from valve seats in said combustion chamber to respective port openings formed in the same exterior surface of said cylinder head, a spark plug well formed in the exterior of said cylinder head and adapted to receive a spark plug for said combustion chamber, said passages and said spark plug well lying substantially on one side of said cylinder head, a cooling jacket formed by the portions of said cylinder head defining said passages and said spark plug well, and means for directing said coolant flow in a generally vertical direction through said cooling jacket, comprising a coolant inlet formed in a lower surface of said cylinder head adapted to engage an associated cylinder block and positioned between said passages, and an outlet from said cooling jacket formed vertically above said coolant inlet.

2. A cooling jacket arrangement as set forth in claim 1 further including a second cooling jacket formed in the cylinder head spaced from the first mentioned cooling jacket and wherein a portion of the coolant flow from the first cooling jacket is redirected from its vertical flow to said second cooling jacket.

3. A cooling jacket arrangement for a cylinder head of an internal combustion engine defining in part a combustion chamber, a pair of passages extending from valve seats in said combustion chamber to respective port openings formed in the same exterior surface of said cylinder head, a spark plug well formed in the exterior of said cylinder head and adapted to receive a spark plug for said combustion chamber, said passages and said spark plug well lying substantially on one side of said cylinder head, a cooling jacket formed by the portions of said cylinder head defining said passages and said spark plug well, and means for directing said coolant flow in a generally vertical direction through said cooling jacket comprising a coolant inlet formed in a lower surface of said cylinder head adapted to engage an associated cylinder block and positioned between said passages and an outlet formed in the exterior side of the cylinder head through which the port openings are formed.

4. A cooling jacket arrangement as set forth in claim 3 wherein the outlet is formed between the port openings.

5. A cooling jacket arrangement as set forth in claim 4 further including a second cooling jacket formed in the cylinder head spaced from the first mentioned cooling jacket and wherein a portion of the coolant flow from the first cooling jacket is redirected from its vertical flow to said second cooling jacket.

6. A cooling jacket arrangement for a cylinder head of an internal combustion engine defining in part a combustion chamber, a pair of passages extending from valve seats in said combustion chamber to respective port openings formed in the same exterior surface of said cylinder head, a spark plug well formed in the exterior of said cylinder head and adapted to receive a spark plug for said combustion chamber, said passages and said spark plug well lying substantially on one side of said cylinder head, a cooling jacket formed by the portions of said cylinder head defining said passages and said spark plug well, and means for directing said coolant flow in a generally vertical direction through said cooling jacket comprising a coolant inlet formed in a lower surface of said cylinder head adapted to engage an associated cylinder block and positioned between said passages, the inlet comprises a passage that extends to the top of said cooling jacket.

7. A cooling jacket arrangement as set forth in claim 6 wherein the cooling inlet passage is formed integrally with the cylinder head.

8. A cooling jacket arrangement as set forth in claim 6 wherein the cooling inlet passage is formed integrally with the cylinder head.

9. A cooling jacket arrangement as set forth in claim 8 wherein the inlet passage is formed in part by a insert in the cylinder head.

10. A cooling jacket arrangement as set forth in claim 8 wherein the inlet passage is formed in part by a insert in the cylinder head.

11. A cooling jacket arrangement as set forth in claim 10 wherein the passages and spark plug well form a generally vertically extending wall that separates the cooling jacket from the other side of the cylinder head.

12. A cooling jacket arrangement as set forth in claim 11 wherein the means for directing coolant flow comprises a coolant inlet formed in a lower surface of the cylinder head adapted to engage the cylinder block and positioned between the passages.

13. A cooling jacket arrangement as set forth in claim 12 wherein the means for directing coolant flow further includes an outlet from the cooling jacket formed vertically above the coolant inlet.

14. A cooling jacket arrangement as set forth in claim 13 further including a second cooling jacket formed in the cylinder head spaced from the first mentioned cooling jacket and wherein a portion of the coolant flow from the first cooling jacket is redirected from its vertical flow to said second cooling jacket.

15. A cooling jacket arrangement as set forth in claim 13 further including a second cooling jacket formed in the cylinder head spaced from the first mentioned cooling jacket and wherein a portion of the coolant flow from the first cooling jacket is redirected from its vertical flow to said second cooling jacket.

16. A cooling jacket arrangement as set forth in claim 12 wherein the inlet passage extends to the top of the cooling jacket.

17. A cooling jacket arrangement as set forth in claim 12 wherein the means for directing coolant flow further comprises an outlet formed in the exterior side of the cylinder head through which the port openings are formed.

18. A cooling jacket arrangement as set forth in claim 17 wherein the outlet is formed between the port openings.

* * * * *

UNITED STATES PATENT AND TRADEMARK OFFICE

CERTIFICATE OF CORRECTION

PATENT NO. : 5,081,960

DATED : January 21, 1992

INVENTOR(S) : Makoto Shimamoto

It is certified that error appears in the above-identified patent and that said Letters Patent is hereby corrected as shown below:

Column 10, line 56, Claim 10, "8" should be --7--.

Signed and Sealed this

Fifth Day of October, 1993

Bruce Lehman

*Attest:*

BRUCE LEHMAN

*Attesting Officer*

*Commissioner of Patents and Trademarks*